US011710610B2

(12) United States Patent
Yokoyama et al.

(10) Patent No.: US 11,710,610 B2
(45) Date of Patent: Jul. 25, 2023

(54) INPUT APPARATUS

(71) Applicant: Alps Alpine Co., Ltd., Tokyo (JP)

(72) Inventors: Kazuhiro Yokoyama, Fukushima (JP); Takao Igarashi, Miyagi (JP); Hajime Suzuki, Miyagi (JP)

(73) Assignee: Alps Alpine Co., Ltd.

( * ) Notice: Subject to any disclaimer, the term of this patent is extended or adjusted under 35 U.S.C. 154(b) by 180 days.

(21) Appl. No.: 17/377,469

(22) Filed: Jul. 16, 2021

(65) Prior Publication Data

US 2021/0343492 A1 Nov. 4, 2021

Related U.S. Application Data

(63) Continuation of application No. PCT/JP2020/002096, filed on Jan. 22, 2020.

(30) Foreign Application Priority Data

Feb. 7, 2019 (JP) ..... 2019-021006

(51) Int. Cl.
*H01H 25/04* (2006.01)

(52) U.S. Cl.
CPC ..... *H01H 25/04* (2013.01)

(58) Field of Classification Search
CPC ..... H01H 2003/323; H01H 2215/028; H01H 2221/064; H01H 2227/034; H01H 9/223;
(Continued)

(56) References Cited

U.S. PATENT DOCUMENTS 5,219,070 A * 6/1993 Grunert ..... H01H 71/56 200/332
6,737,594 B2 * 5/2004 Helms ..... H01H 9/286 200/43.14

(Continued)

FOREIGN PATENT DOCUMENTS

JP 2000-195383 A 7/2000
JP 2002-312047 A 10/2002

(Continued)

OTHER PUBLICATIONS

International Search Report for corresponding international Application No. PCT/JP020/002096 dated Mar. 31, 2020 (2 pages).

*Primary Examiner* — Ahmed M Saeed
(74) *Attorney, Agent, or Firm* — Hamess, Dickey & Pierce, P.L.C.

(57) ABSTRACT

An input apparatus includes a casing including an opening, a knob exposed to outside along a virtual central axis, a first support member that supports the knob so as to be capable of a first operation, a second support member that supports the first support member so as to be capable of a second operation of the knob, a first detection member that detects the first operation, a second detection member that detects the second operation, and a detachable regulating member that regulates movement of the second detection member. The second support member includes a groove extending parallel to the virtual central axis. When the second operation is to be disabled, the regulating member including a rib to be fitted in the groove is attached. When the second operation is to be enabled, the regulating member not including a rib to be fitted in the groove is attached.

7 Claims, 17 Drawing Sheets

(58) Field of Classification Search
CPC ..... H01H 9/282; H01H 19/02; H01H 2011/0025; H01H 71/56; H01H 9/22; H01H 9/281; H01H 23/143; H01H 23/30; H01H 23/025; H01H 2300/03; H01H 23/145; H01H 2221/016; H01H 23/14; H01H 23/04; H01H 23/168; H01H 2221/018; H01H 23/02; H01H 23/12; H01H 23/003; H01H 23/146; H01H 23/16; H01H 23/20; H01H 23/28; H01H 23/00; H01H 23/148; H01H 23/24; H01H 23/26
See application file for complete search history.

(56) References Cited

U.S. PATENT DOCUMENTS

| | | | | |
|---|---|---|---|---|
| 2002/0148317 | A1 | 10/2002 | Onodera | |
| 2012/0018286 | A1* | 1/2012 | Knoerrchen ..... | H01H 9/282 200/43.11 |
| 2012/0260761 | A1 | 10/2012 | Yamazaki et al. | |
| 2022/0293365 | A1* | 9/2022 | Choi ..... | H01H 25/008 |

FOREIGN PATENT DOCUMENTS

| | | | |
|---|---|---|---|
| JP | 2006-286334 | A | 10/2006 |
| JP | 2012-204069 | A | 10/2012 |

* cited by examiner

INPUT APPARATUS

CLAIM OF PRIORITY

This application is a Continuation of International Application No. PCT/JP2020/002096 filed on Jan. 22, 2020, which claims benefit of Japanese Patent Application No. 2019-021006 filed on Feb. 7, 2019. The entire contents of each application noted above are hereby incorporated by reference.

BACKGROUND OF THE INVENTION

1. Field of the Invention

The present invention relates to an input apparatus.

2. Description of the Related Art

An input apparatus is known in which a knob can be rotated. Another input apparatus is also known in which multiple kinds of operation of a knob, such as a tilt operation and a rotating operation, can be performed. (See Japanese Unexamined Patent Application Publication No. 2015-158970 and Japanese Unexamined Patent Application Publication No. 2018-37362)

Conventional input apparatuses have been individually designed for the kind of possible operation of a knob. For that reason, for example, an input apparatus capable of three kinds of operation of the knob cannot be used as an input apparatus capable of two kinds of operation of the knob. As a result, in preparing a product equipped with an input apparatus capable of three kinds of operation of the knob and a product equipped with an input apparatus capable of two kinds of operation of the knob, two kinds of input apparatuses have to be designed, causing the problem of increasing the man-hours for designing.

SUMMARY OF THE INVENTION

The present invention provides an input apparatus in which the kinds of possible operations of the knob 1 can easily be changed.

An input apparatus according to an embodiment includes a casing including an opening, a knob exposed to outside along a virtual central axis passing through the opening of the casing, the knob being to be operated by a user, a first support member that supports the knob so as to be capable of a first operation, a second support member that supports the first support member so as to be capable of a second operation of the knob, a first detection member that detects the first operation, a second detection member that detects the second operation, and a regulating member detachably attached to the casing, the regulating member regulating movement of the second detection member, wherein the second support member includes at least one groove in an outer peripheral surface, the groove extending in a direction parallel to the virtual central axis, wherein, when the second operation by the user is to be disabled, the regulating member including a rib to be fitted in the groove is attached, and wherein, when the second operation by the user is to be enabled, the regulating member not including a rib to be fitted in the groove is attached.

DESCRIPTION OF THE PREFERRED EMBODIMENTS

Embodiments of the present invention will be described hereinbelow with reference to the attached drawings. For the specification and the drawings according to the embodiments, components with substantially the same functional configuration are given the same reference signs, and duplicate descriptions will be omitted.

An input apparatus 100 according to an embodiment will be described with reference to FIG. 1 to FIG. 17. The input apparatus 100 is an input apparatus in which the kinds of possible operations of a knob 1 can be changed by replacing one component (a regulating member 7). The regulating member 7 includes two kinds, which are referred to as regulating members 7A and 7B. The input apparatus 100 can be used as, for example, an input apparatus for products in which the operation of the knob 1 is used. The products in which the operation of the knob 1 is used include a vehicle and a game controller, but are not limited thereto.

The input apparatus 100 is capable of two or more kinds of operations of the knob 1 including a first operation and a second operation. The first operation is an operation not including the horizontal movement of the knob 1. The first operation includes a rotating operation, a pressing operation, and a touch operation but is not limited to these operations. The second operation is an operation including the horizontal movement of the knob 1. The second operation includes a tilt operation and a slide operation but is not limited to these operations. The input apparatus 100 may be capable of only the first operation or only the second operation or, in addition to the first operation and the second operation, one or more kinds of operation different from the first operation and not including the horizontal movement of the knob 1.

The input apparatus 100 is capable of regulating the second operation by replacing the regulating member 7. The input apparatus 100 can be used as an input apparatus incapable of the second operation of the knob 1 by attaching the regulating member 7A as the regulating member 7 and can be used as an input apparatus capable of the second operation of the knob 1 by attaching the regulating member 7B as the regulating member 7. In other words, the input apparatus 100 can change in the kind of possible operation of the knob 1 by replacing the regulating member 7.

This embodiment illustrates the input apparatus 100 in which the first operation is a rotating operation, the second operation is a tilt operation, and a third operation is a pressing operation by way of example. In this embodiment, the first operation may be a pressing operation or a touch operation, the second operation may be a slide operation, and the third operation may be a rotating operation or a touch operation.

Figure 1:
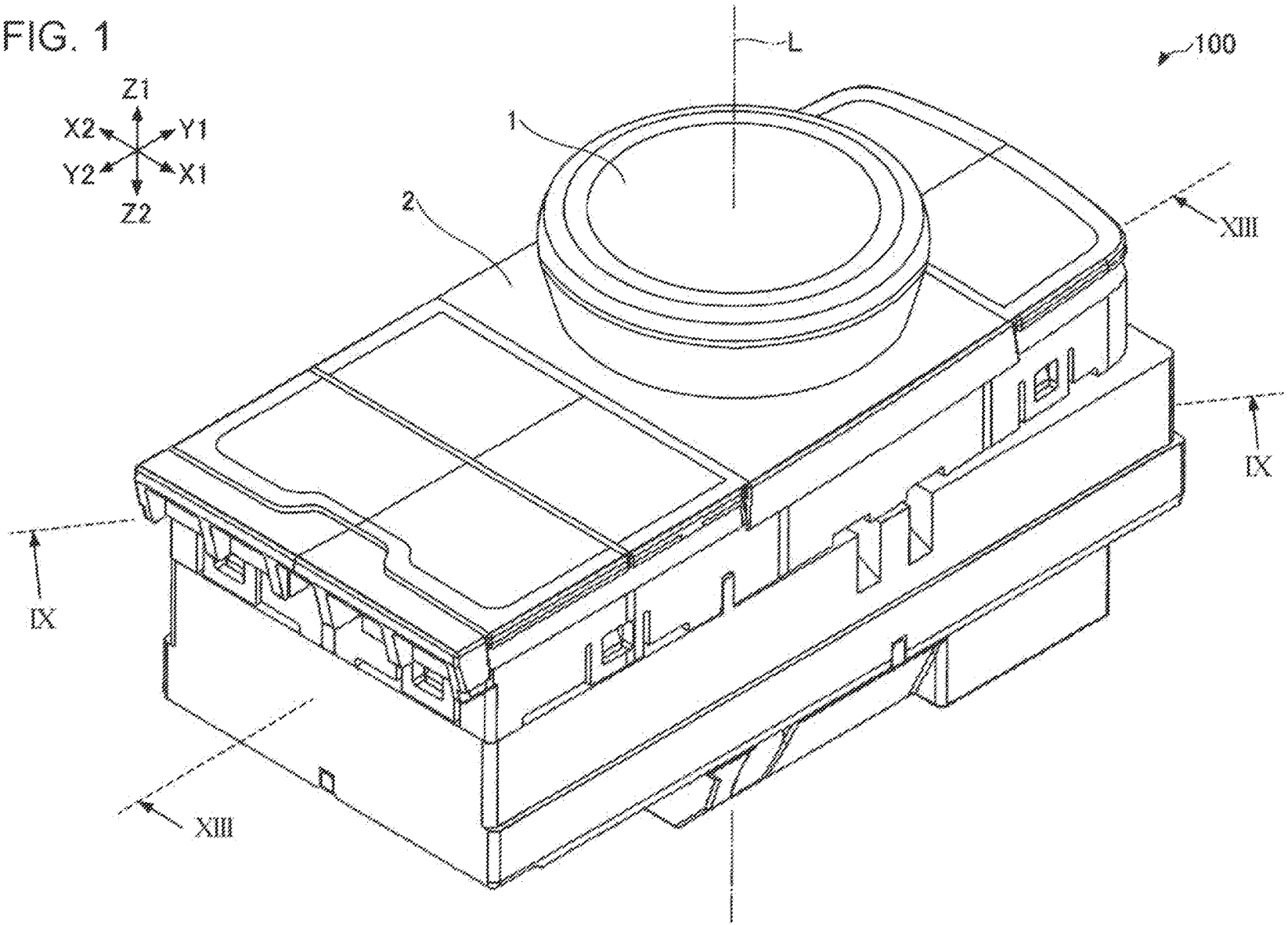
FIG. 1 is an external perspective view of an example of an input apparatus.
Figure 2:
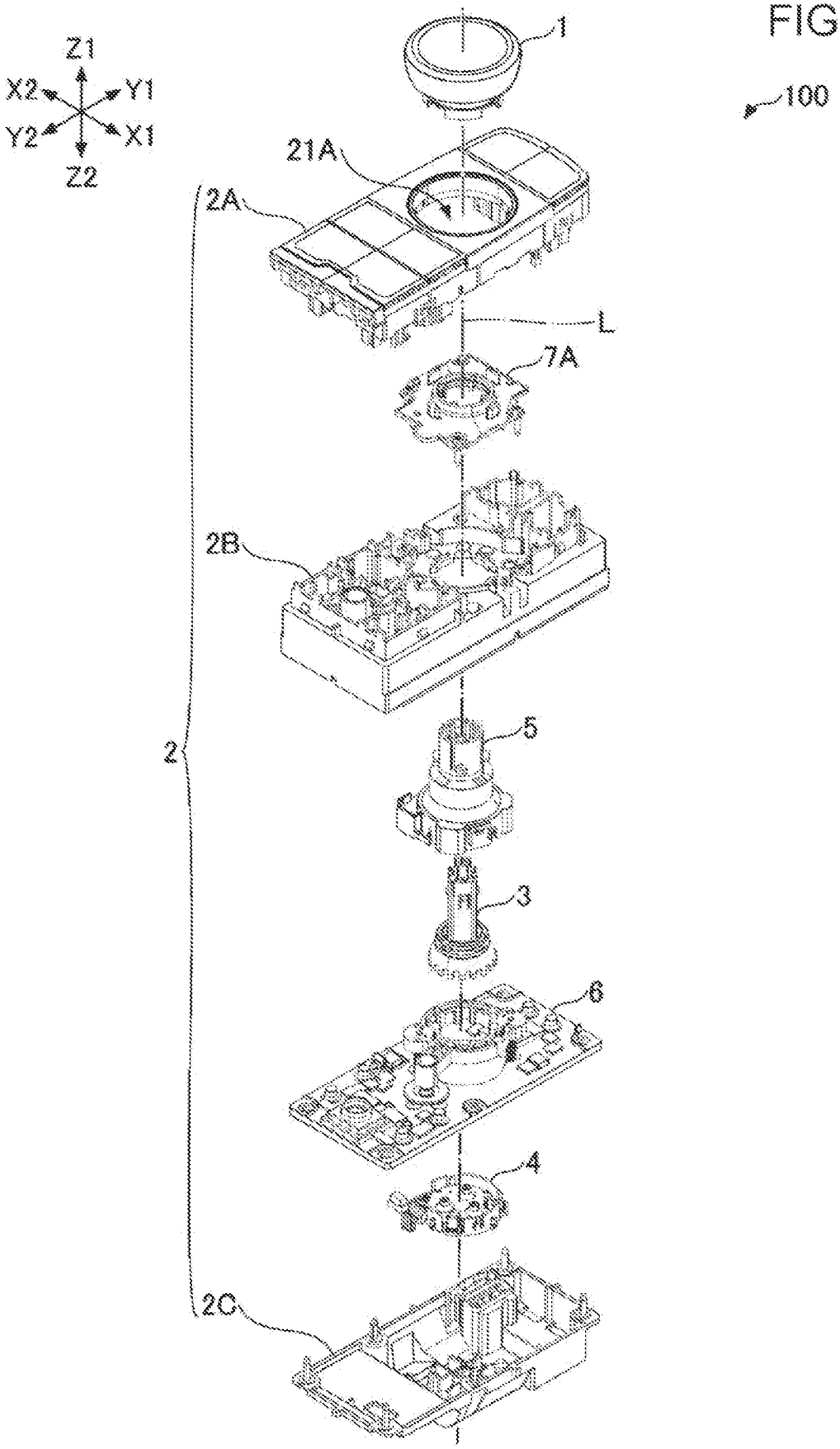
FIG. 2 is an exploded perspective view of the input apparatus in FIG. 1.
Figure 3:
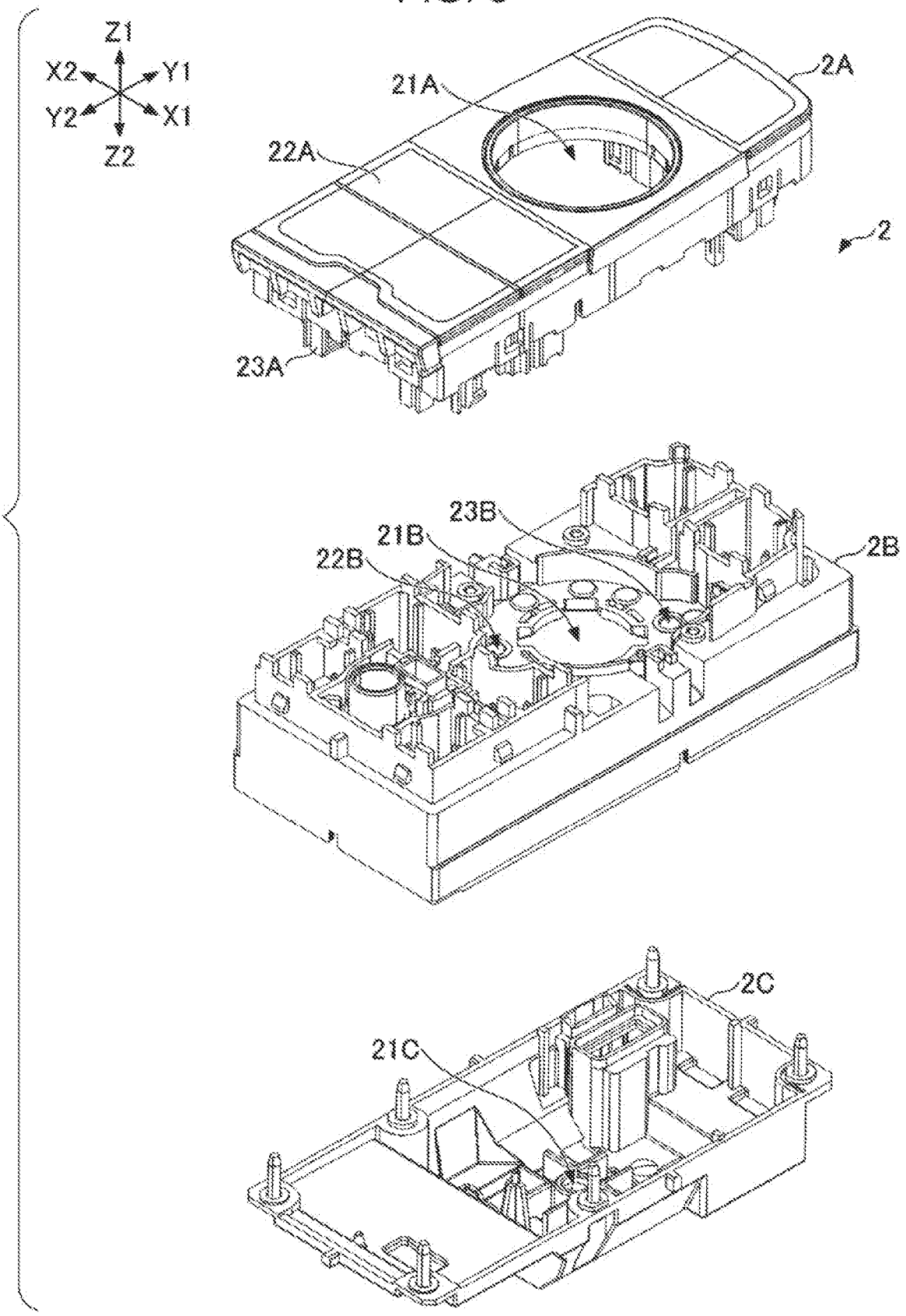
FIG. 3 is an exploded perspective view of a casing of the input apparatus in FIG. 1.
Figure 4:
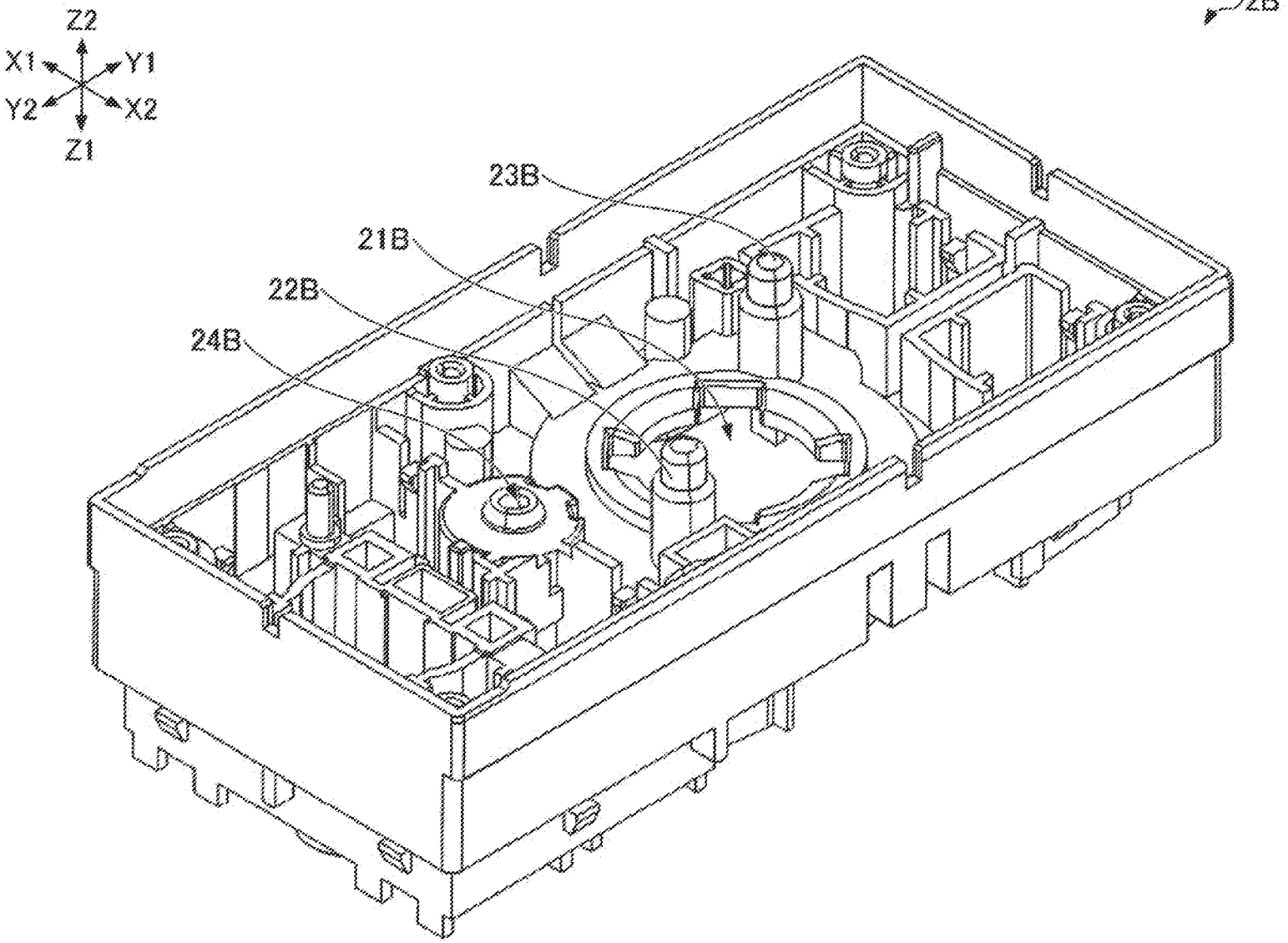
FIG. 4 is a perspective view of a middle casing of the input apparatus in FIG. 1 seen from below.
Figure 5:
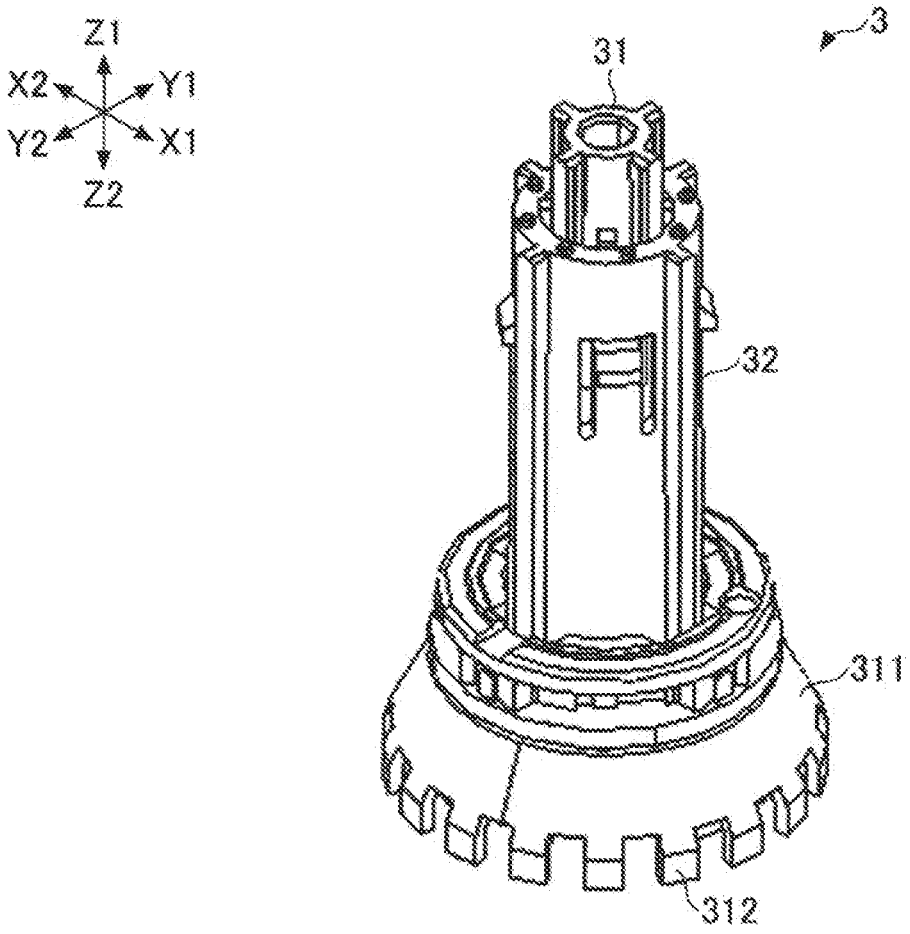
FIG. 5 is a perspective view of a first support member of the input apparatus in FIG. 1.
Figure 6:
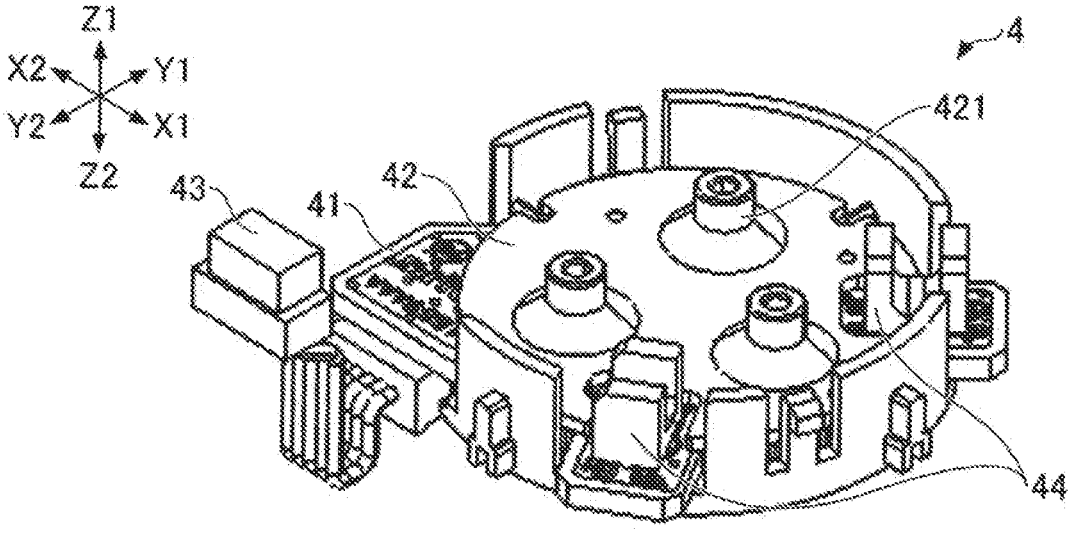
FIG. 6 is a perspective view of a first detection member of the input apparatus in FIG. 1.
Figure 7:
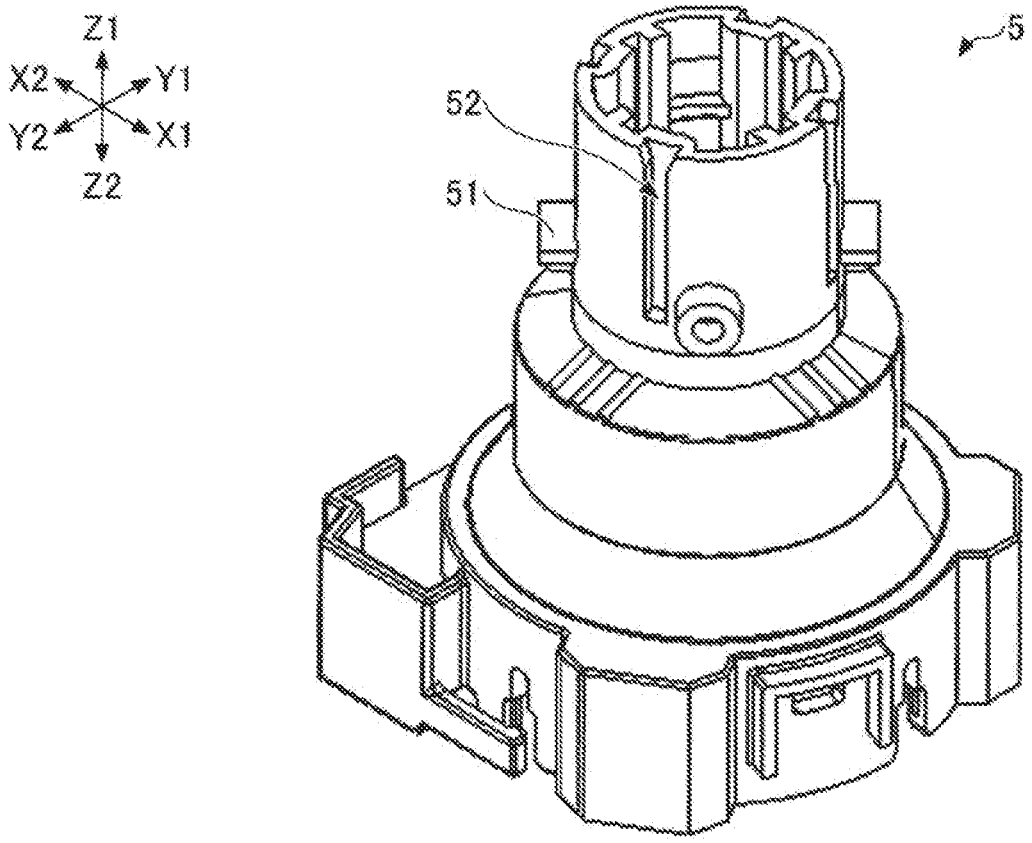
FIG. 7 is a perspective view of a second support member of the input apparatus in FIG. 1.
Figure 8:
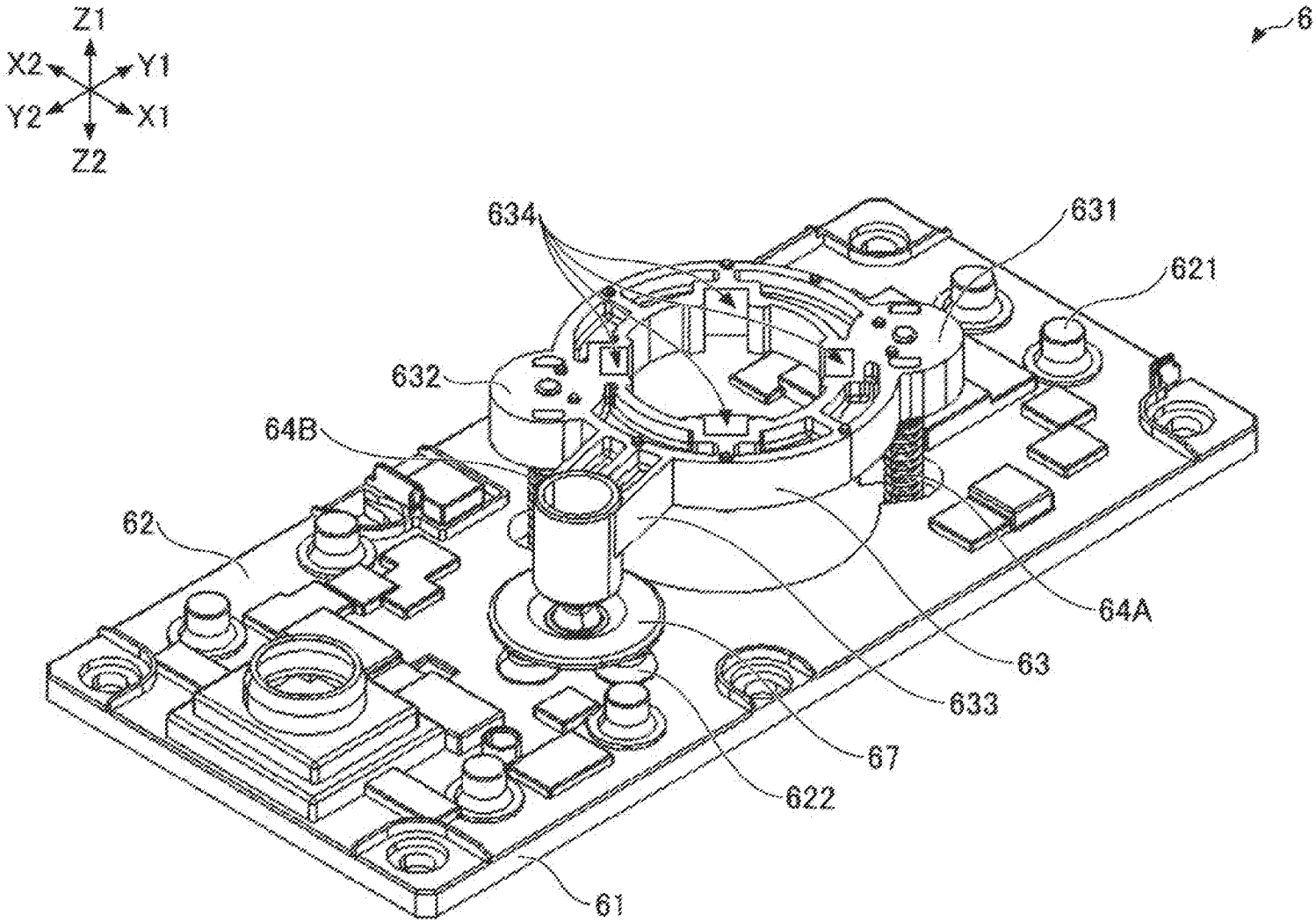
FIG. 8 is a perspective view of a second detection member of the input apparatus in FIG. 1.
Figure 9:
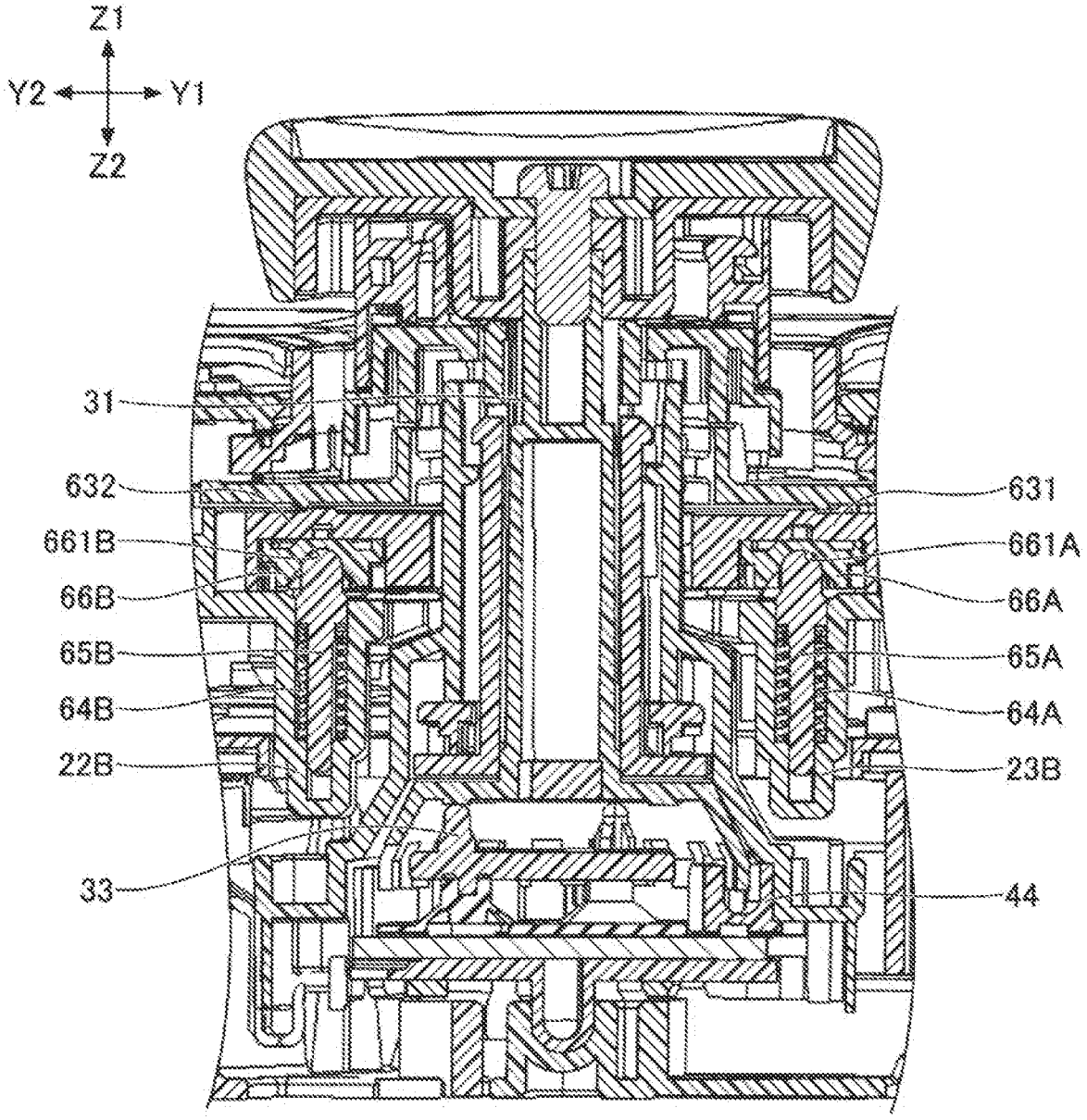
FIG. 9 is a cross-sectional view of the input apparatus in FIG. 1 taken along line IX-IX.
Figure 10:
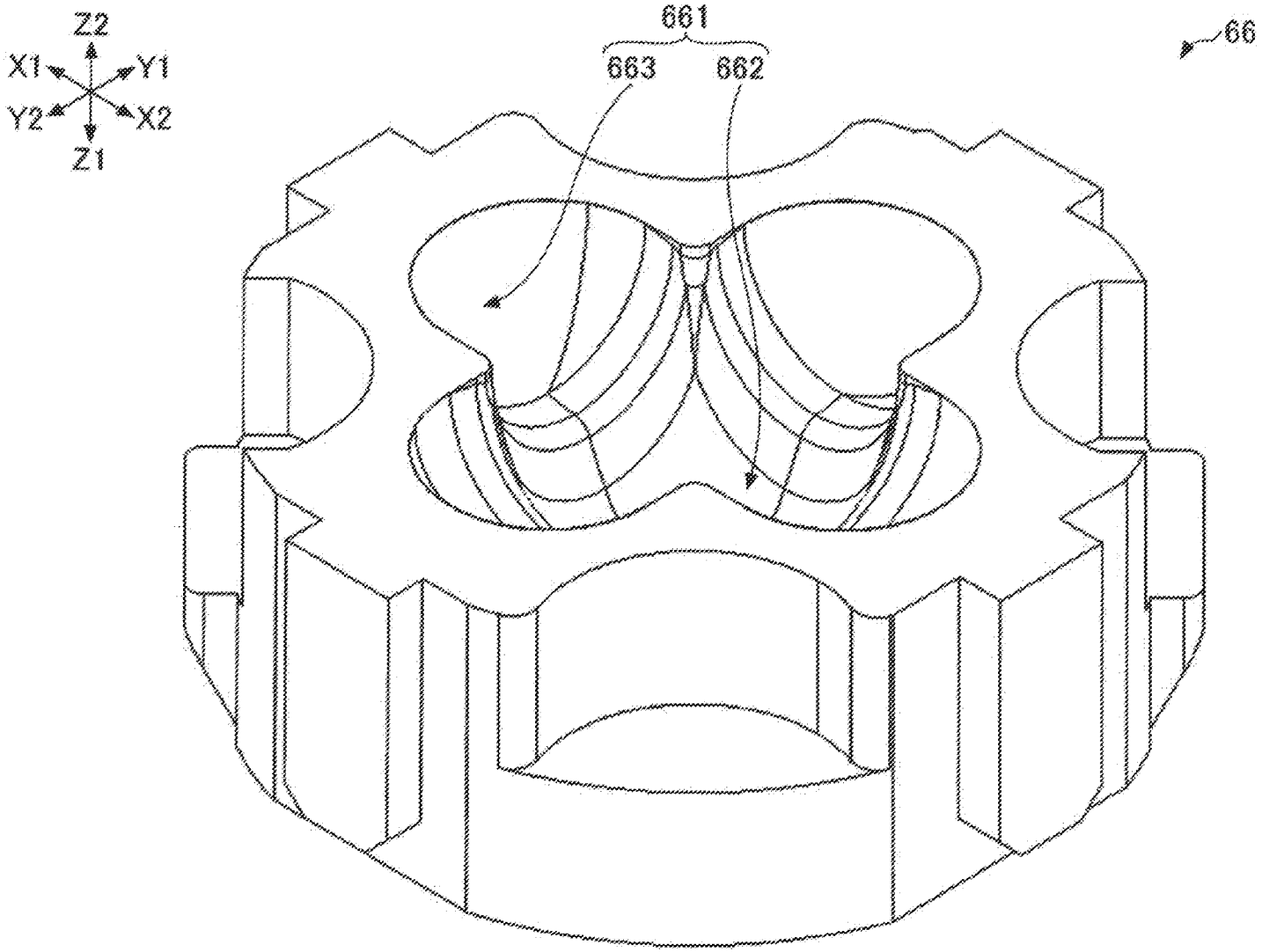
FIG. 10 is a perspective view of a cam of the input apparatus in FIG. 1 seen from below.
Figure 11:
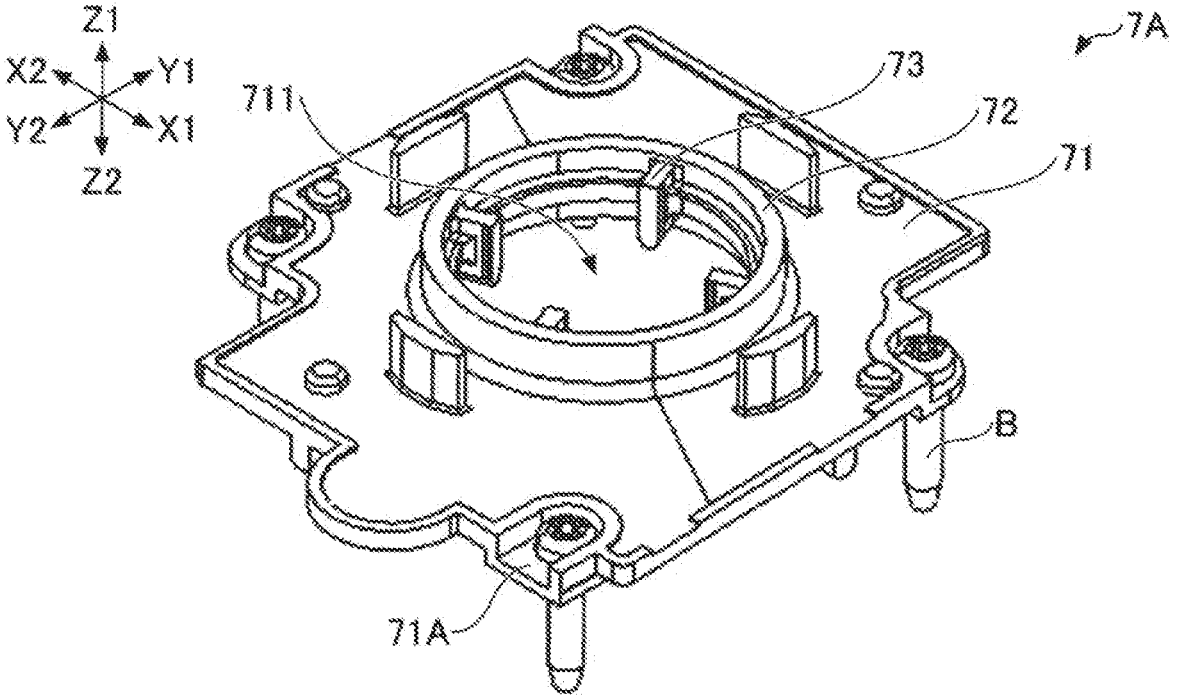
FIG. 11 is a perspective view of a regulating member of the input apparatus in FIG. 1.
Figure 12:
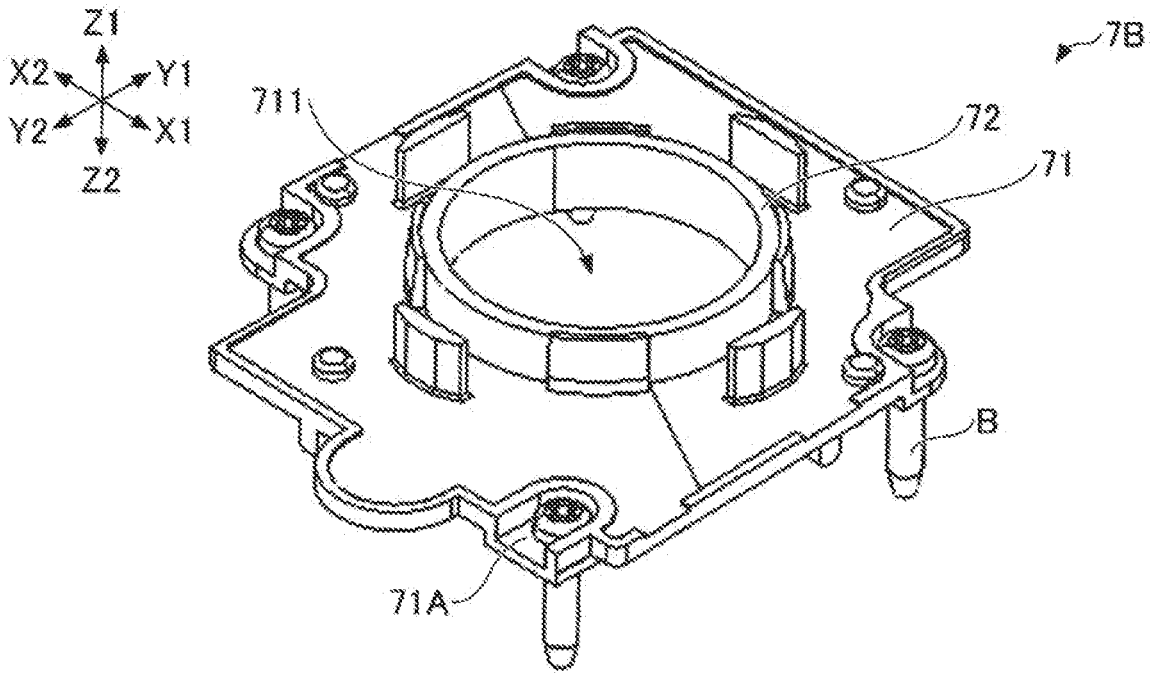
FIG. 12 is a perspective view of an example of the regulating member.
Figure 13:
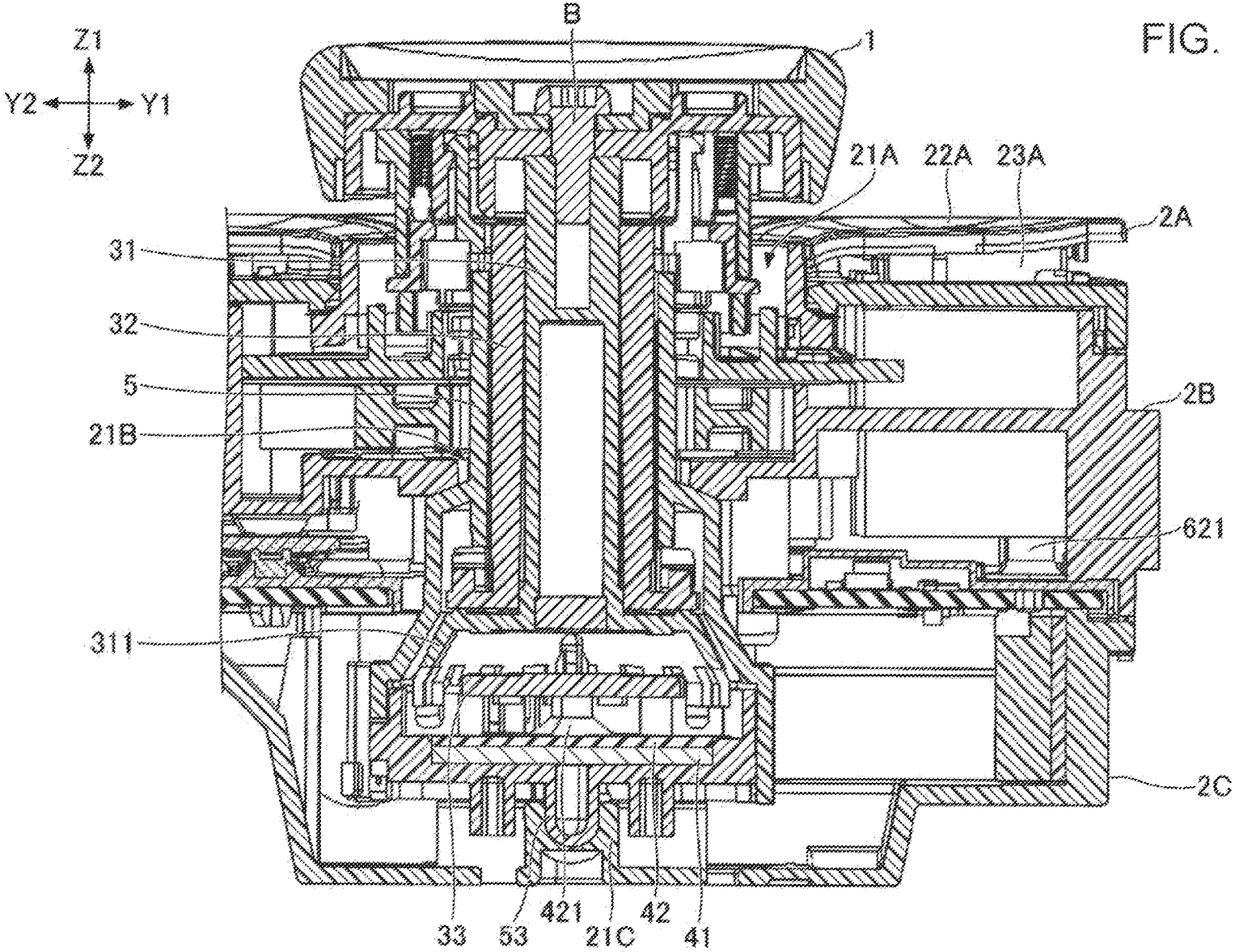
FIG. 13 is a cross-sectional view of the input apparatus in FIG. 1 taken along line XIII-XIII.
Figure 14:
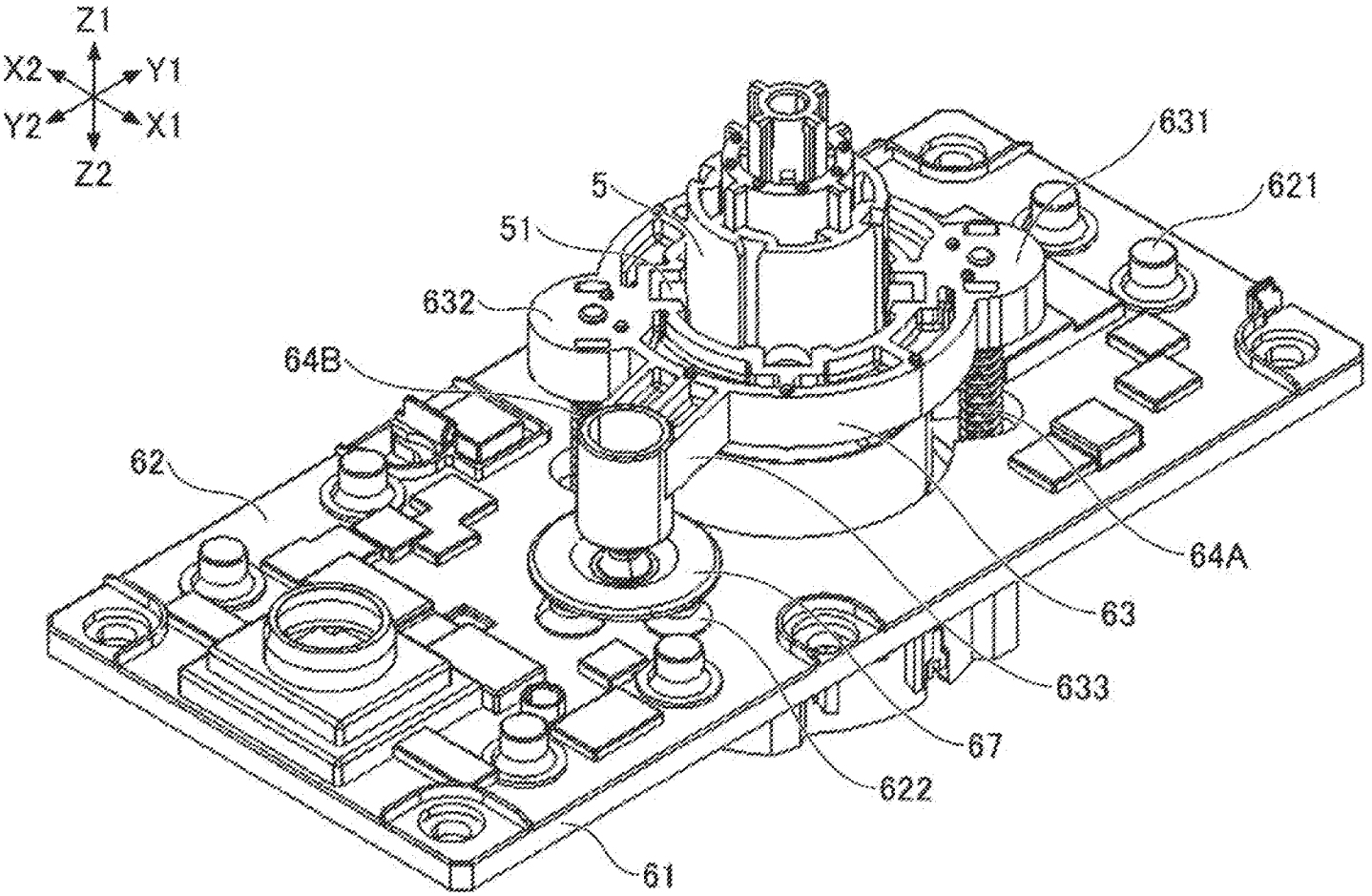
FIG. 14 is a perspective view of the input apparatus in FIG. 1 without a knob and the casing.
Figure 15:
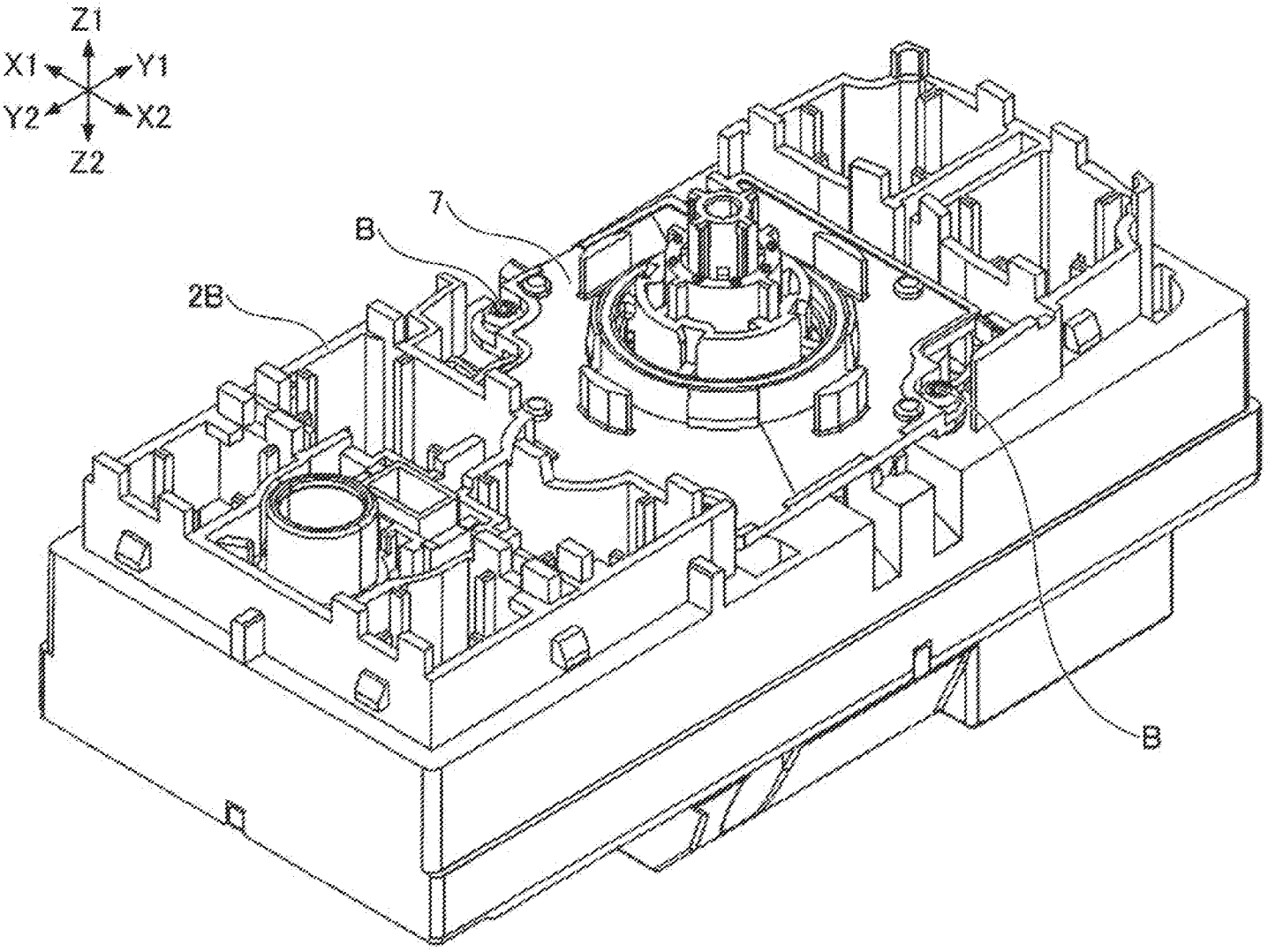
FIG. 15 is a perspective view of the input apparatus in FIG. 1 without the knob and an upper casing.
Figure 16:
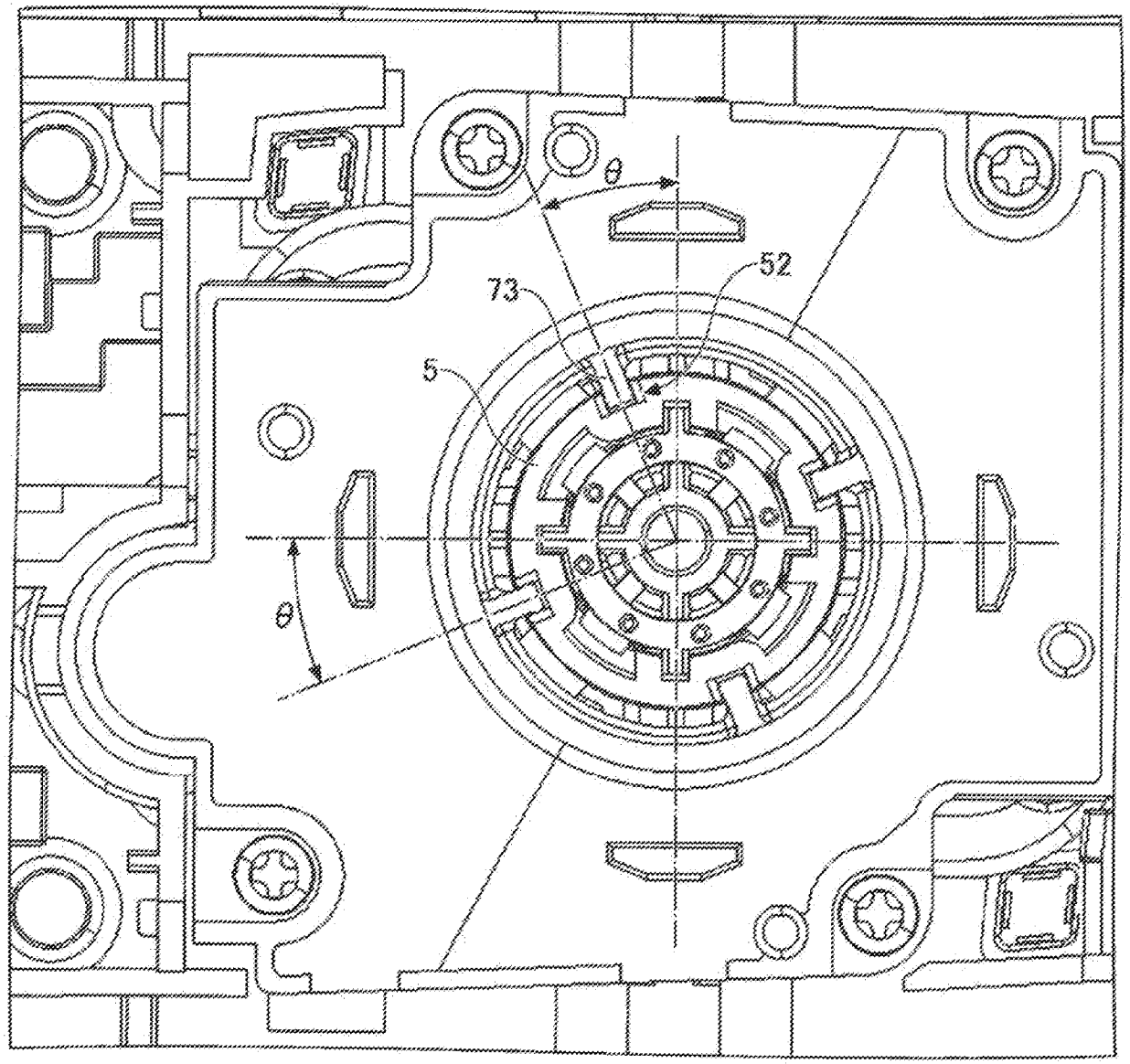
FIG. 16 is a top view of the input apparatus in FIG. 1 without the knob and the upper casing.
Figure 16:
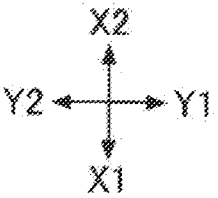
Figure 17:
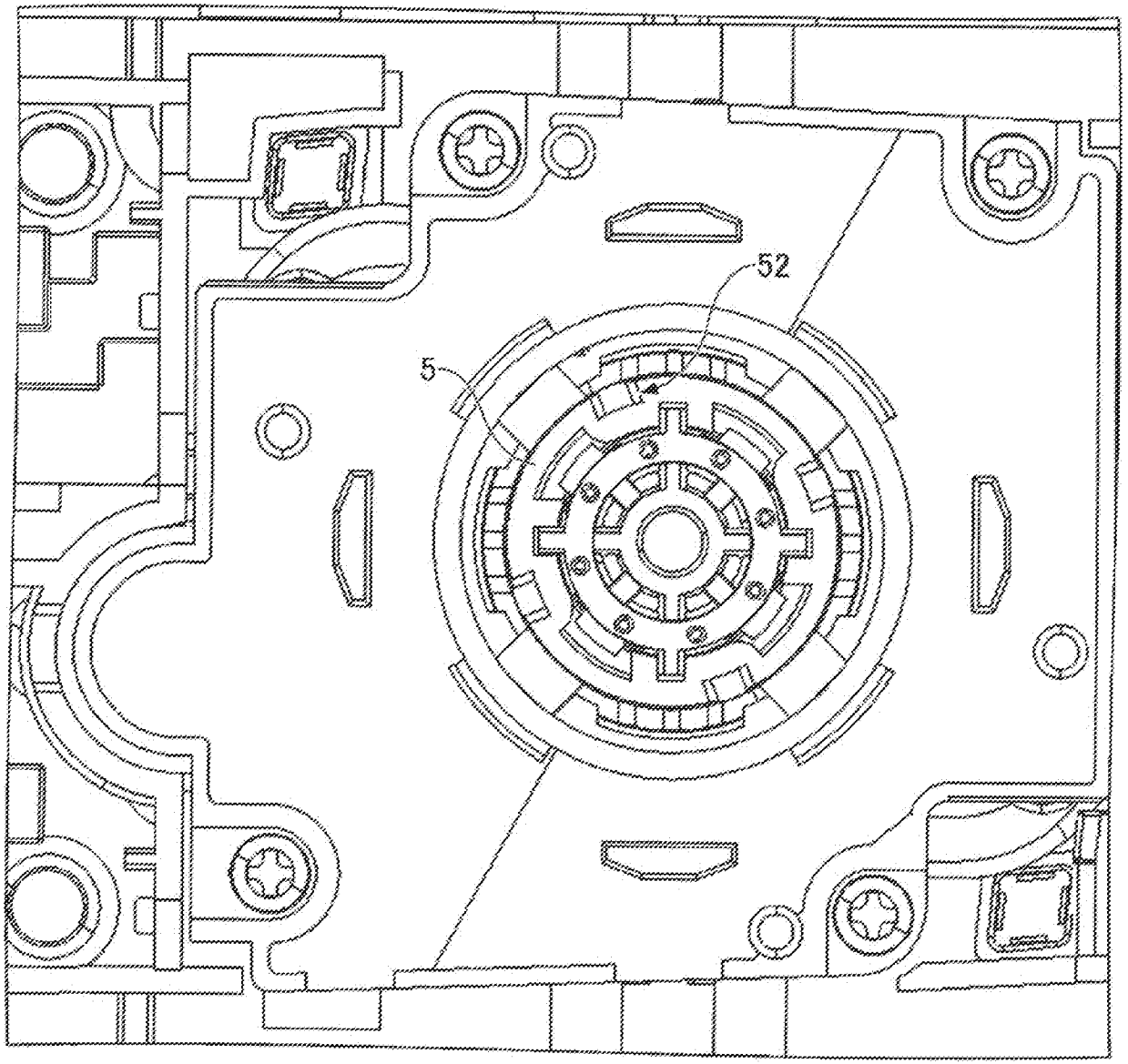
FIG. 17 is a top view of a modification of the input apparatus in FIG. 1 without the knob and the upper casing.
Figure 17:
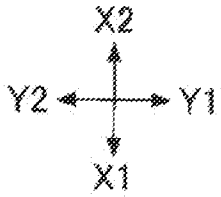

FIG. 1 is an external perspective view of an example of the input apparatus 100. FIG. 2 is an exploded perspective view of the input apparatus 100 in FIG. 1. FIG. 3 is an exploded perspective view of a casing 2 of the input apparatus 100 in FIG. 1. FIG. 4 is a perspective view of a middle casing 2B of the input apparatus 100 in FIG. 1 seen from below. FIG. 5 is a perspective view of a first support member 3 of the input apparatus 100 in FIG. 1. FIG. 6 is a perspective view of a first detection member 4 of the input apparatus 100 in FIG. 1. FIG. 7 is a perspective view of a second support member 5 of the input apparatus 100 in FIG. 1. FIG. 8 is a perspective view of a second detection member 6 of the input apparatus 100 in FIG. 1. FIG. 9 is a cross-sectional view of the input apparatus 100 in FIG. 1 taken along line IX-IX. The IX-IX line is a straight line passing through the centers of actuators 65A and 65B. FIG. 10 is a perspective view of a cam 66 of the input apparatus 100 in FIG. 1 seen from below. FIG. 11 is a perspective view of the regulating member 7A of the input apparatus 100 in FIG. 1. FIG. 12 is a perspective view of an example of the regulating member 7B. FIG. 13 is a cross-sectional view of the input apparatus 100 in FIG. 1 taken along line XIII-XIII. The line XIII-XIII is a straight line extending in the Y-direction through a virtual central axis L. FIG. 14 is a perspective view of the input apparatus 100 in FIG. 1 without the knob 1 and the casing 2. FIG. 15 is a perspective view of the input apparatus 100 in FIG. 1 without the knob 1 and an upper casing 2A. FIG. 16 is a top view of the input apparatus 100 in FIG. 1 without the knob 1 and the upper casing 2A. FIG. 17 is a top view of the input apparatus 100 including the regulating member 7B (a modification of the input apparatus 100 in FIG. 1) without the knob 1 and the upper casing 2A.

The input apparatus 100 will be described hereinbelow with reference to the directions (X1-, X2-, Y1-, Y2-, Z1-, and Z2-directions) in the drawings. The X1- and X2-directions are collectively referred to as X-direction, the Y1- and Y2-directions are collectively referred to as Y-direction, and the Z1- and Z2-directions are collectively referred to as Z-direction. The X-, Y-, and Z-directions cross each other at right angles. The Z1-direction and the Z2-direction are sometimes referred to as "above" and "below", respectively.

As shown in FIG. 2, the input apparatus 100 includes the knob 1, the casing 2, the first support member 3, the first detection member 4, the second support member 5, the second detection member 6, and the regulating member 7A.

The knob 1 is a member to be operated by the user. The knob 1 in FIG. 1 has a substantially columnar shape and is fixed to the first support member 3 at the lower surface (see FIG. 13). The knob 1 is supported by the first support member 3 so as to be exposed to the outside through an opening 21A of the casing 2 along the virtual central axis L extending in the Z-direction (see FIG. 1 and FIG. 2).

The possible operations of the knob 1 include the rotating operation (the first operation), the tilt operation (the second operation), and the pressing operation (the third operation), as described above. The rotating operation of the knob 1 is the operation of rotating the knob 1 rotatably supported by the first support member 3 about the virtual central axis L in the X-Y plane. The tilt operation of the knob 1 is the operation of tilting the knob 1 in at least one of the X-direction and the Y-direction which cross the virtual central axis L. The pressing operation of the knob 1 is the operation of moving the knob 1 supported by the first support member 3 in the direction (Z2-direction) parallel to the virtual central axis L. The knob 1 moves horizontally when tilted but does not move horizontally when rotated or pressed. The horizontal movement here refers to movement in the X-Y plane, that is, movement in at least one of the X-direction and the Y-direction.

The configuration of the knob 1 is not limited to the illustrated example. The knob 1 may have any shape that allows the user to operate the knob 1.

The casing 2 is a member that contains the first support member 3, the first detection member 4, the second support member 5, the second detection member 6, and the regulating member 7. As shown in FIG. 3, the casing 2 includes the upper casing 2A, the middle casing 2B, and a lower casing 2C.

The upper casing 2A is a member constituting the upper part of the casing 2. The upper casing 2A is fixed to the top of the middle casing 2B. The upper casing 2A includes an opening 21A, a plurality of push buttons 22A, and a plurality of pressing portions 23A.

The opening 21A is an opening formed at the top of the upper casing 2A for the knob 1, the first support member 3, and the second support member 5 to pass through. The opening 21A is wider than the moving range of the outer periphery of the knob 1 so as to tilt the knob 1 (see FIG. 13).

The push buttons 22A are push buttons disposed on the top of the upper casing 2A. The push buttons 22A are arranged so as to be exposed to the top of the upper casing 2A. The push buttons 22A allows multiple input methods for the input apparatus 100. The shape and number of the push buttons 22A are not limited to the example in FIG. 3. The upper casing 2A does not have to include the push buttons 22A.

The pressing portions 23A are portions extending downward from the lower surfaces of the push buttons 22A. The pressing portions 23A are provided at the lower surfaces of the push buttons 22A. The lower ends of the pressing portions 23A are in contact with the upper surfaces of dome portions 621 and press the dome portions 621 directly or indirectly by the pushing operation on the push buttons 22A (see FIG. 13, the detailed shape is not illustrated). The dome portions 621 will be described later.

The middle casing 2B is a member constituting the central portion of the casing 2 in the Z-direction. The middle casing 2B is fixed to the bottom of the upper casing 2A and fixed to the top of the lower casing 2C. Some components of the second detection member 6 and the regulating member 7 are attached to the top of the middle casing 2B. The middle casing 2B includes an opening 21B, holding portions 22B and 23B, and a through-hole 24B.

The opening 21B is an opening formed at the top of the middle casing 2B for the knob 1, the first support member 3, and the second support member 5 to pass through. The opening 21B is wider than the moving ranges of the outer peripheries of the knob 1, the first support member 3, and the second support member 5 so as to tilt the knob 1 (see FIG. 13).

The holding portions 22B and 23B are recessed portions protruding downward from the top of the middle casing 2B (protrusions in FIG. 4). The holding portions 22B and 23B are formed around the opening 21B. The holding portions 22B and 23B hold coil springs 64A and 64B and actuators 65A and 65B, respectively (see FIG. 9). The coil springs 64A and 64B and the actuators 65A and 65B will be described later.

The through-hole 24B is formed between the top and the bottom of the middle casing 2B for the upper end of a pressing member 67 to pass through (see FIG. 8). The through-hole 24B is formed in an area adjacent to the opening 21B. The pressing member 67 will be described later.

The lower casing 2C is a member constituting the lower part of the casing 2. The lower casing 2C is fixed to the bottom of the middle casing 2B. The components of the first detection member 4 and the second detection member 6 are held between the bottom of the middle casing 2B and the top of the lower casing 2C. At the top of the lower casing 2C, a recess 21C that supports a support portion 53 of the second support member 5 is provided (see FIG. 13).

The configuration of the casing 2 is not limited to the illustrated example. The casing 2 may have any configuration in which the first support member 3, the first detection member 4, the second support member 5, the second detection member 6, and the regulating member 7 can be housed.

The first support member 3 supports the knob 1 so as to be capable of the rotating operation (the first operation) and the pressing operation (the third operation). The first support member 3 has a substantially shaft shape extending in the direction (Z-direction) parallel to the virtual central axis L and includes a shaft 31, a bearing member 32, and a pressing member 33 (see FIG. 5 and FIG. 13).

The shaft 31 is a substantially cylindrical member extending in the direction (Z-direction) parallel to the virtual central axis L. The shaft 31 is rotatably supported by the bearing member 32 and in contact with the top of the pressing member 33 (see FIG. 9 and FIG. 13). The lower surface of the knob 1 is fixed to the upper end of the shaft 31 with a bolt B. When the knob 1 is rotated, the shaft 31 rotates around the virtual central axis L along with the knob 1. When the knob 1 is tilted, the shaft 31 tilts in a direction crossing the virtual central axis L together with the knob 1. When the knob 1 is pressed, the shaft 31 moves in the direction parallel to the virtual central axis L together with the knob 1. The direction parallel to the virtual central axis L coincides with the Z-direction when the tilt operation of the knob 1 is not performed. The shaft 31 has a light shielding portion 311 at the lower end.

AS shown in FIG. 5, the light shielding portion 311 is a dome-shaped portion expanding outward and downward from the lower end of the shaft 31. The lower end of the light shielding portion 311 has substantially rectangular protrusions 312 at regular intervals. The light shielding portion 311 constitutes part of an optical rotation sensor (a rotation detection circuit). Since the light shielding portion 311 rotates along with the knob 1, the first detection member 4 can detect the rotation of the knob 1, as will be described later.

The bearing member 32 is a cylindrical member that supports the shaft 31 so as to be capable of rotating about the virtual central axis L and moving in the direction parallel to the virtual central axis L. The bearing member 32 is fixed to the second support member 5 and has the shaft 31 passed therethrough. In other words, the bearing member 32 is disposed between the shaft 31 and the second support member 5 (see FIG. 13). The bearing member 32 functions as a bearing that reduces the influence of the shaft 31 rotating and moving therein exerted on the second support member 5.

The pressing member 33 supports the shaft 31 from below. As shown in FIG. 13, the pressing member 33 is disposed under the shaft 31 and in contact with the top of the dome portions 421. When the knob 1 is pressed, the shaft 31 moves downward in the direction parallel to the virtual central axis L to push the dome portions 421 via the pressing member 33. The dome portions 421 will be described later.

The configuration of the first support member 3 is not limited to the illustrated example. For example, the first support member 3 does not have to include the bearing member 32, and the shaft 31 and the pressing member 33 may be integrally formed. The first support member 3 may have any configuration in which the knob 1 can be supported so as to be rotated and pressed.

The first detection member 4 detects the rotating operation and the pressing operation (the respective examples of the "first operation" and the "third operation") of the knob 1. The first detection member 4 is disposed under the first support member 3 and is fixed to the lower casing 2C. The first detection member 4 includes a circuit board 41, a sheet member 42, and a connecting terminal 43 (see FIG. 6).

The circuit board 41 is a board on which a rotation detection circuit for detecting the rotating operation of the knob 1 and a pressure detection circuit for detecting the pressing operation of the knob 1 are mounted. The circuit board 41 may be either a rigid board or a flexible board.

The rotation detection circuit is of an optical type and includes transmissive light sensors 44 in which a light-emitting diode (LED) and a light-receiving element are integrated. The rotation detection circuit receives reflected light of the light emitted from the LED with the light-receiving element. When the knob 1 is rotated, the light shielding portion 311 rotates along with the knob 1 to change the reflected light of the light emitted from the LED, as described above. This allows the rotational speed (rotation angle) of the knob 1 to be calculated from a change in the wave form output from the light-receiving element.

The pressure detection circuit includes a plurality of fixed contacts arranged away from each other and a detection circuit that detects continuity between the fixed contacts. The pressure detection circuit will be described later.

The sheet member 42 is made of an elastic member, such as silicon rubber, which is disposed so as to cover the upper surface of the circuit board 41. The sheet member 42 functions as a dust-protective sheet and a waterproof sheet for the circuit board 41. The sheet member 42 includes three dome portions 421.

The dome portions 421 are dome-shaped portions protruding upward from the upper surface of the sheet member 42. The dome portions 421 are arranged evenly under the pressing member 33 so as to stably support the pressing member 33. The dome portions 421 are formed so as to cover the plurality of fixed contacts. A movable contact is fixed to the lower surfaces of the dome portions 421 so as to cover the plurality of fixed contacts.

When the knob 1 is pressed, the dome portions 421 are pressed via the pressing member 33, as described above. The dome portions 421 are buckled when pressed by a force equal to or greater than a predetermined value, and the lower surfaces of which come into contact with the surface of the circuit board 41. When the lower surfaces of the dome portions 421 come into contact with the surface of the circuit board 41, the movable contact fixed to the lower surfaces of the dome portions 421 and the plurality of fixed contacts disposed under the dome portions 421 come into contact to bring the fixed contacts into conduction. By detecting the conduction using the detection circuit, the pressing operation of the knob 1 can be detected.

When the pressing operation of the knob 1 ends (the user releases the knob 1), the shape of the dome portions 421 is recovered by the elastic force of the sheet member 42. This causes the first support member 3 to be pushed up into its original position. As a result, the knob 1 returns to its original position (initial position).

The connecting terminal 43 is a terminal for connecting the circuit board 41 and a circuit board 61. The output signal from the circuit board 41 (the detection result of the rotating operation or the pressing operation) is output to an apparatus outside the input apparatus 100 via the circuit board 61. The circuit board 61 will be described later.

The configuration of the first detection member 4 is not limited to the illustrated example. For example, the rotation detection circuit may be of a magnetic type or a photoelectric type. The pressure detection circuit may be constituted of a disc spring. The sheet member 42 may include one, two, or four or more dome portions 421. The first detection member 4 may have any configuration in which the rotating operation and the pressing operation of the knob 1 can be detected.

The second support member 5 is a cylindrical member that supports the first support member 3 so as to allow the tilt operation of the knob 1. The second support member 5 has the first support member 3 inserted therethrough and is fixed to the bearing member 32 along the inner peripheral surface. When the knob 1 is tilted, the first support member 3 tilts, so that the second support member 5 fixed to the bearing member 32 tilts along with the first support member 3. The second support member 5 is connected to an annular member 63. The annular member 63 will be described later. As shown in FIG. 7, the second support member 5 includes four protrusions 51, four grooves 52, and the support portion 53.

The protrusions 51 are substantially columnar members extending outward from the outer peripheral surface of the second support member 5. The protrusions 51 are disposed in connecting grooves 634 of the annular member 63 with flexibility in the Z-direction. The four protrusions 51 are arranged at regular intervals around the outer peripheral surface of the second support member 5. When the knob 1 is tilted, the second support member 5 tilts, and the annular member 63 connected to the second support member 5 moves in the horizontal direction (in the X-Y plane) along with the tilting movement of the second support member 5. More specifically, when the knob 1 is tilted, the second support member 5 tilts, and the protrusions 51 push the wall surfaces of the connecting grooves 634 in the horizontal direction while moving in the connecting grooves 634 of the annular member 63 in the Z-direction, so that the tilting operation of the second support member 5 is converted to a slide operation of the annular member 63 in the horizontal direction. The number of the protrusions 51 is not limited to the illustrated example. The connecting structure of the second support member 5 and the annular member 63 in the case where the knob 1 is slid in the horizontal direction (in the X-Y plane) is the same as that in the tilt operation except that the protrusions 51 do not move in the Z-direction in the connecting grooves 634. By the slide operation of the knob 1, the annular member 63 slides in the same direction as the direction of the slide operation.

The grooves 52 are formed along the outer peripheral surface of the second support member 5 and extend in the direction (Z-direction) parallel to the virtual central axis L. The grooves 52 fit in ribs 73 extending in the direction (Z-direction) parallel to the virtual central axis L of the regulating member 7A (see FIG. 11 and FIG. 16). The tight fit of the grooves 52 and the ribs 73 allows the tilt of the second support member 5 to be regulated to hold the knob 1 on the virtual central axis L. The four grooves 52 are formed at regular intervals in the outer peripheral surface around the virtual central axis L of the second support member 5. The grooves 52 are disposed at a predetermined angle θ (in this embodiment, for example, θ is about 15 to 25 degrees) to the direction of the tilt operation of the knob 1 (the X-direction and the Y-direction). This disperses a load, if exerted on the second support member 5 in the horizontal direction, to the plurality of grooves 52, preventing damage to the grooves 52. The number and the disposition angle of the grooves 52 are not limited to the illustrated example.

As shown in FIG. 13, the support portion 53 is a protrusion provided at the lower end of the second support member 5. The support portion 53 is supported in the recess 21C provided on the top of the lower casing 2C and functions as a tilt support portion for the second support member 5. In other words, the second support member 5 tilts with the support portion 53 as the fulcrum.

The configuration of the second support member 5 is not limited to the illustrated example. The second support member 5 may have any configuration in which the first support member 3 can be supported so that the knob 1 can be tilted.

The second detection member 6 is a member for detecting the tilt operation (an example of the "second operation") of the knob 1. Some components of the second detection member 6 are held between the top of the middle casing 2B and the regulating member 7, and the other component are held between the bottom of the middle casing 2B and the top of the lower casing 2C. As shown in FIG. 8 to FIG. 10, the second detection member 6 includes a circuit board 61, a sheet member 62, an annular member 63, coil springs 64A and 64B, actuators 65A and 65B, cams 66A and 66B, and a pressing member 67.

The circuit board 61 is a board on which a tilt detection circuit for detecting the tilt operation of the knob 1 is mounted. The circuit board 61 may be a rigid board or a flexible board. The circuit board 61 has output terminals (not shown), on the lower surface, for outputting output signals from the circuit boards 41 and 61 to an external apparatus.

The tilt detection circuit includes a plurality of fixed contacts arranged away from each other and a detection circuit that detects continuity between the fixed contacts. The tilt detection circuit will be described later.

The sheet member 62 is made of an elastic member, such as silicon rubber, which is disposed so as to cover the upper surface of the circuit board 61. The sheet member 62 functions as a dust-protective sheet and a waterproof sheet for the circuit board 61. The sheet member 62 includes a plurality of dome portions 621 and four dome portions 622.

The dome portions 621 are dome-shaped portions protruding upward from the upper surface of the sheet member 62. The plurality of dome portions 621 are disposed in contact with the lower portions of the individual pressing portions 23A passing through through-holes (not shown) of the middle casing 2B. The dome portions 621 are formed so as to cover the plurality of fixed contacts. A movable contact is fixed to the lower surfaces of the dome portions 621 so as to cover the plurality of fixed contacts.

When the push button 22A is pressed, the dome portion 621 is pressed via the pressing portion 23A provided on the lower surface of the push button 22A. The dome portion 621 is buckled when pressed by a force equal to or greater than a predetermined value, and the lower surface of which comes into contact with the surface of the circuit board 61. When the lower surface of the dome portion 621 comes into contact with the surface of the circuit board 61, the movable contact fixed to the lower surface of the dome portion 621 and the plurality of fixed contacts disposed under the dome portion 621 come into contact to bring the fixed contacts into conduction. By detecting the conduction using the detection circuit, the pressing operation of the push button 22A can be detected.

When the pressing operation of the push button 22A ends (the user releases the push button 22A), the shape of the dome portion 621 is recovered by the elastic force of the sheet member 62. This causes the push button 22A to be pushed up into its original position. As a result, the knob 1 returns to its original position.

The dome portions 622 are dome-shaped portions protruding upward from the upper surface of the sheet member 62. The four dome portions 622 are disposed in contact with the lower surface of the pressing member 67. The four dome portions 622 are arranged at regular intervals in the operating directions of the knob 1 (X1, X2, Y1, and Y2) with respect to the center of the pressing member 67 so as to stably support the pressing member 67. The dome portions 622 are formed so as to cover the plurality of fixed contacts. A movable contact is fixed to the lower surface of the dome portion 622 so as to cover the plurality of fixed contacts. The operation of the dome portion 622 will be described later.

The annular member 63 is a ring-shaped member that converts the tilt operation of the knob 1 to a slide operation in the horizontal direction. The annular member 63 is disposed around the outer peripheral surface of the second support member 5 and is connected to the second support member 5. The annular member 63 is held so as to be movable in the horizontal direction in a state in which the height in the Z-direction (the position movable to the direction parallel to the virtual central axis L) is regulated by the top of the middle casing 2B and the bottom of the regulating member 7. The annular member 63 includes cam fixing portions 631 and 632, a pressing portion 633, and connecting grooves 634.

The cam fixing portions 631 and 632 protrude outward from the outer periphery of the annular member 63 and are formed at opposite positions with respect to the virtual central axis L. The cams 66A and 66B are fixed to the lower surfaces of the cam fixing portions 631 and 632, respectively. In this embodiment, the cams 66 with the same shape are arranged in balance at opposite positions. Alternatively, the annular member 63 may include three or more cam fixing portions or one cam fixing portion.

The pressing portion 633 will be described later.

The connecting grooves 634 are formed in the inner peripheral surface of the annular member 63 and extend in the Z-direction. The connecting grooves 634 are connected to the protrusions 51 of the second support member 5 so that the protrusions 51 can move in the Z-direction.

As shown in FIG. 9, the coil springs 64A and 64B are elastic members which are disposed in the holding portions 22B and 23B of the middle casing 2B, have the actuators 65A and 65B passed therethrough, respectively, and are supported so as to extend in the Z-direction. The coil springs 64A and 64B are in contact with the bottoms of the holding portions 22B and 23B at the lower ends and in contact with the lower surfaces of the contact portions of the actuators 65A and 65B at the upper ends to urge the actuators 65A and 65B upward, respectively.

The actuators 65A and 65B are rod-like members which are disposed in the holding portions 22B and 23B of the middle casing 2B, passed through the coil springs 64A and 64B, respectively, and extend in the Z-direction. The actuator 65 includes a contact portion thicker than the coil spring 64 at the top. The lower surface of the contact portion is in contact with the upper end of the coil spring 64. The actuator 65 is urged upward by the coil spring 64.

The cams 66A and 66B have cam faces 661A and 661B at the lower surfaces and are fixed to the lower surfaces of the cam fixing portions 631 and 632, respectively. The upper end of the actuator 65 is urged by the coil spring 64 to come into contact with the cam face 661 of the cam 66.

As shown in FIG. 10, the cam face 661 is shaped like a cross. More specifically, the cam face 661 includes a recess 662 at the center and a guide curve 663 inclined from the recess 662 in the direction of the tilt operation (the X-direction and the Y-direction). The recess 662 corresponds to the initial position of the knob 1 and is in contact with the upper end of the actuator 65 while the knob 1 is at the initial position. When the knob 1 is tilted, the cam face 661 is inclined as the annular member 63 inclines to bring the guide curve 663 and the upper end of the actuator 65 into contact with each other. This changes the load from the actuator 65 on the cam 66 at the tilt operation, thereby causing click feeling. Furthermore, the contact between the guide curve 663 and the actuator 65 causes a load on the cam face 661 in the direction in which the cam 66 is returned to the initial position. This allows the knob 1 (the cam 66) to be automatically returned to the initial position at the end of the tilt operation.

The pressing member 67 is a disc-like member that selectively presses the dome portions 622 of the sheet member 62. The pressing member 67 is disposed in contact with the top of the four dome portions 622 and under the end of the pressing portion 633 of the annular member 63. The pressing member 67 passes through the through-hole 24B of the middle casing 2B and is supported so as to be capable of oscillation in the vicinity of the lower outlet of the through-hole 24B, so that the pressing member 67 can be tilted in the directions of the four dome portions 622.

The pressing portion 633 protrudes outward from the outer periphery of the annular member 63, and the end of the pressing portion 633 extends downward. The end of the pressing portion 633 is disposed around the periphery of the upper end of the pressing member 67 and presses the upper end of the pressing member 67 at the movement to tilt the pressing member 67 in the moving direction.

When the knob 1 is tilted, the annular member 63 slides in the tilting direction along with the second support member 5 because the height of the annular member 63 is regulated by the regulating member 7. When the end of the pressing portion 633 moves in the operating direction of the knob 1, the pressing member 67 is pressed in the operating direction to tilt toward the dome portion 622 disposed on the operating direction side, with the center of the pressing member 67 as the fulcrum to push the dome portion 622 disposed on the operating direction side downward.

The dome portion 622 is buckled when pressed with a force equal to or greater than a predetermined value, and the inner surface of the dome facing the circuit board 61 comes into contact with the surface of the circuit board 61. When the facing surface of the dome portion 622 comes into contact with the surface of the circuit board 61, the movable contact fixed to the facing surface of the dome portion 622 and the plurality of fixed contacts disposed on the surface of the circuit board 61 come into contact to make the fixed contacts electrically conducted. By detecting the conduction using the detection circuit, the tilt operation of the knob 1 in the operating direction can be detected.

When the tilt operation of the knob 1 ends (the user releases the knob 1), the shape of the dome portion 622 is recovered by the elastic force of the sheet member 62. This causes the pressing member 67 to be pushed up by the recovering force of the shape of the dome portion 622. The annular member 63 is pressed together with the cam 66 in the direction along the cam face 661 by the elastic force of the coil spring 64 to the actuator 65 in contact with the cam 66. As a result, the annular member 63 returns to the original position to return the knob 1 to the original position.

The configuration of the second detection member 6 is not limited to the illustrated example. For example, the tilt detection circuit may be formed of a disc spring. The second detection member 6 may be urged by one or three or more coil springs 64. The sheet member 62 may have two or more sets of four dome portions 622 for detecting the tilt operation of the knob 1, or alternatively, the four dome portions 622 may be pressed by different pressing members 67. The second detection member 6 may have any configuration in which the tilt operation of the knob 1 can be detected.

The regulating member 7 regulates the movement of the second detection member 6 in the direction (Z-direction) parallel to the virtual central axis L. As shown in FIG. 15, the regulating member 7 is detachably attached to the middle casing 2B with bolts B. The regulating member 7 is disposed on the annular member 63, which is a component of the second detection member 6, and regulates the movement of the annular member 63 in the Z-direction by holding the annular member 63 between the bottom of the regulating member 7 and the top of the middle casing 2B. This allows the stable movement of the annular member 63 in the slide direction (the direction crossing the virtual central axis L).

In this embodiment, the regulating member 7 includes the regulating member 7A and the regulating member 7B. The regulating member 7A is a regulating member 7 that regulates the tilt of the second support member 5, and the regulating member 7B is a regulating member 7 that does not regulate the tilt of the second support member 5. As shown in FIG. 11, the regulating member 7A includes a plate-like portion 71, an annular portion 72, and four ribs 73.

The plate-like portion 71 is a flat portion including attaching portions 71A each having a through-hole (not shown), through which the bolt B is to be passed, at the four corners and is attached to the top of the middle casing 2B with the bolts B. The upper surface of the annular member 63 urged upward by the coil spring 64 is pushed against the lower surface of the plate-like portion 71. The plate-like portion 71 includes an opening 711 at the center through which the second support member 5 is to be passed.

The annular portion 72 is a ring-shaped portion around the opening 711 formed in the plate-like portion 71. The ribs 73 are formed at the inner peripheral surface of the annular portion 72.

The ribs 73 protrude from the inner peripheral surface of the annular portion 72 inward in the Z-direction. The ribs 73 are fitted in the grooves 52 of the second support member 5 by being inserted in the grooves 52 from above to below when the regulating member 7A is attached to the middle casing B2 to regulate the tilt of the second support member 5. The four ribs 73 are individually formed at the positions corresponding to the grooves 52 of the second support member 5. The ribs 73 are arranged at positions at a predetermined angle θ with respect to the operating direction of the knob 1 (the X-direction and the Y-direction).

The configuration of the regulating member 7A is not limited to the illustrated example. For example, if the ribs 73 can be formed on the inner peripheral surface of the opening 711, the regulating member 7A does not have to include the annular portion 72. The number of the ribs 73 is not limited to the illustrated example. A means for attaching the regulating member 7 to the middle casing 2B is not limited to the bolts B. The regulating member 7A may have any configuration that regulates the movement of the second detection member 6 in the direction parallel to the virtual central axis L and allows the movement in the direction crossing the virtual central axis L.

In the case where the regulating member 7A is attached to the middle casing 2B, the four ribs 73 are fitted to the corresponding grooves 52, as shown in FIG. 16, to regulate the tilt of the second support member 5. This makes it impossible to tilt the knob 1. In other words, the input apparatus 100 is an input apparatus capable of the rotating operation and the pressing operation of the knob 1.

The ribs 73 are disposed at positions forming a predetermined angle θ with respect to the operating direction of the knob 1 (the X-direction and the Y-direction). This causes, when a load in the horizontal direction is applied to the second support member 5, a load on all of the ribs 73 that form a predetermined angle (θ or 90°−θ) with respect to the operating direction. This causes the operating load to be dispersed to more multiple ribs 73 than those of a case in which the predetermined angle is zero (θ=0), that is, a case in which only ribs 73 that are parallel to or orthogonal to the operating direction are provided. This allows damage to the ribs 73 to be prevented.

In contrast, the regulating member 7B includes a plate-like portion 71 and an annular portion 72, as shown in FIG. 12. In other words, the configuration of the regulating member 7B is the same as that of the regulating member 7A except that the ribs 73 are not provided.

When the regulating member 7B is attached to the middle casing 2B as the regulating member 7, a gap is formed between the second support member 5 and the regulating member 7B, as shown in FIG. 17. Therefore, the tilt of the second support member 5 is not regulated. This allows the tilt operation of the knob 1. In other words, the input apparatus 100 is an input apparatus capable of the rotating operation, the tilt operation, and the pressing operation of the knob 1.

Thus, according to this embodiment, the input apparatus 100 with the regulating member 7A is capable of the rotating operation and the pressing operation of the knob 1, and the input apparatus 100 with the regulating member 7B is capable of the rotating operation, the tilt operation, and the pressing operation of the knob 1. In other words, whether to allow the tilt operation of the knob 1 in the input apparatus 100 can be changed by replacing the regulating member 7. The regulating member 7 can easily be replaced because it is detachably attached to the middle casing 2B. The input apparatus 100 can easily change in the kinds of possible operations of the knob 1 (whether to allow the tilt operation).

The configurations of the regulating members 7A and 7B are the same except whether the ribs 73 are present. This allows two kinds of regulating member 7 to be easily designed and manufactured. This reduces the design cost of the input apparatus 100. For assembly process, the same facilities can be used, reducing the facility investment.

It is to be understood that the present invention is not limited to the illustrated configuration, for example, a combination of the above configuration according to the embodiment and another component may be employed. The configuration can be changed without departing from the spirit and scope of the present invention and can be determined according to the application.

For example, this embodiment is configured such that the support portion 53 is provided at the lower end of the second support member 5, and the support portion 53 is supported by the casing 2 to enable the tilt of the second support member 5. Alternatively, the support portion 53 may be eliminated, and the entire second support member 5 may be slidably supported by the casing 2.

What is claimed is:

1. An input apparatus comprising:

a casing including an opening;

a knob exposed to outside along a virtual central axis passing through the opening of the casing, the knob being to be operated by a user;

a first support member that supports the knob so as to be capable of a first operation;

a second support member that supports the first support member so as to be capable of a second operation of the knob;

a first detection member that detects the first operation;

a second detection member that detects the second operation; and a regulating member detachably attached to the casing, the regulating member regulating movement of the second detection member;

wherein the second support member includes at least one groove in an outer peripheral surface, the groove extending in a direction parallel to the virtual central axis, wherein, when the second operation by the user is to be disabled, the regulating member including a rib to be fitted in the groove is attached, and wherein, when the second operation by the user is to be enabled, the regulating member not including a rib to be fitted in the groove is attached.

2. The input apparatus according to claim 1, wherein the at least one groove of the second support member comprises four grooves arranged at regular intervals around the virtual central axis.

3. The input apparatus according to claim 1, wherein the at least one groove of the second support member is disposed at a position forming a predetermined angle with respect to a direction of the second operation.

4. The input apparatus according to claim 1, wherein the first operation is a rotating operation around the virtual central axis or a pressing operation in the direction parallel to the virtual central axis.

5. The input apparatus according to claim 1, wherein the second operation is a tilt operation in a direction crossing the virtual central axis or a slide operation in a direction crossing the virtual central axis.

6. The input apparatus according to claim 1, wherein the first support member supports the knob so as to be capable of a third operation.

7. The input apparatus according to claim 6, wherein the third operation is a pressing operation in the direction parallel to the virtual central axis or a rotating operation around the virtual central axis, the third operation being different from the first operation.

* * * * *